US005730021A

United States Patent [19]

Johnson

[11] Patent Number: 5,730,021

[45] Date of Patent: Mar. 24, 1998

[54] AIR HAMMER BIT

[76] Inventor: Bryan T. Johnson, 4310 Hillview La., Vadnais Heights, Minn. 55127

[21] Appl. No.: 584,090

[22] Filed: Jan. 11, 1996

[51] Int. Cl.[6] ..... B21J 9/18

[52] U.S. Cl. ..... 72/453.01; 72/705; 173/132

[58] Field of Search ..... 72/453.01, 705, 72/457; 173/90, 91, 126, 128, 132, 137

[56] References Cited

U.S. PATENT DOCUMENTS

| | | | |
|---|---|---|---|
| 2,941,429 | 6/1960 | Mason | 72/705 |
| 3,322,209 | 5/1967 | Cavanaugh | 173/132 |
| 3,971,244 | 7/1976 | Zengerer | 72/705 |
| 4,174,113 | 11/1979 | Eckman | 173/132 |
| 4,476,705 | 10/1984 | Meek | 72/705 |
| 5,119,667 | 6/1992 | Hollis et al. | 72/705 |
| 5,329,802 | 7/1994 | Nunez | 72/705 |
| 5,461,900 | 10/1995 | Guiterrez | 72/705 |

FOREIGN PATENT DOCUMENTS

| | | | |
|---|---|---|---|
| 2600572 | 12/1987 | France | 72/705 |
| 4015389 | 11/1991 | Germany | 72/705 |

*Primary Examiner*—Lowell A. Larson
*Assistant Examiner*—Ed Tolan
*Attorney, Agent, or Firm*—Nawrocki, Rooney & Sivertson, P.A.

[57] ABSTRACT

Air hammer bit for use with an air hammer. The bit includes a shaft having a longitudinal axis extending therethrough. A mechanism is integral the shaft for coupling the bit to the air hammer. A bit head extends from the shaft having a center axis which is angled relative to the longitudinal axis of the shaft.

3 Claims, 5 Drawing Sheets

AIR HAMMER BIT

FIELD OF THE INVENTION

The present invention relates to air hammer bits. In particular, the present invention relates to an angled air hammer bit having an angled head and elongate shaft (shank) to aid in using air hammers in hard-to-reach places.

BACKGROUND OF THE INVENTION

Air hammers allow operators to provide high force blows to desired locations in very confined spaces. Conventional air hammer or pneumatic hammer systems typically include a "gun-like" body coupled through a pneumatic hose to a compressed air source. One end of the hammer body includes a grip with a trigger extending from the grip. The grip is connected to the air hammer barrel. At the end of the air hammer barrel is a chuck for coupling an air hammer bit to the air hammer system. The air hammer system is activated by depressing the trigger. Upon activation, the compressed air operates to repeatedly project the air hammer bit outward from the air hammer barrel to perform a desired hammering operation.

FIGS. 1 and 2 show conventional air hammer bits. The air hammer bits include a very short shank or shaft, having a bit head at one end, and a locking mechanism at the other end which extends into the air hammer chuck for coupling the air hammer bit to the air hammer. The air hammer bit head includes a generally smooth, flat contact surface which is generally perpendicular to the longitudinal axis of the air hammer shaft.

Often times applications which require the use of air hammers lack the room to move the air hammer around to optimize the use of the air hammer bit for contacting the work surface. FIGS. 3 and 4 show a typical air hammer application with a very constricted work space. Although the air hammer bit may be able to access the work surface, due to restrictions in work space, only an edge of the air hammer bit head may be able to contact the work surface.

Air hammers are often used in the auto body industry, including smoothing out dents in automotive panels formed of sheet metal. Preferably, the dents are smoothed out of the automotive panel, leaving the panel as smooth as possible. Repairing automotive panels with conventional air hammer bits in restricted spaces often leaves the work surface which is being repaired very rough an uneven. This undesirable result is due to the fact that only the outside edge of the air hammer bit makes contact with the area being repaired.

The air hammer bit in accordance with the present invention provides optimal access by the air hammer to work surfaces in very space-restricted areas. The air hammer bit maximizes contact with the work surface for smoother, more uniform hammering of the work surface.

SUMMARY OF THE INVENTION

The present invention relates to an air hammer bit to aid in using air hammers in hard-to-reach places. The bit includes a shaft having a longitudinal axis extending therethrough. Means are provided integral the shaft for coupling the shaft to the air hammer. A bit head extends from the shaft having a center axis which is angled relative to the longitudinal axis of the shaft.

In one embodiment, the shaft is an elongate shaft. The bit head may further include a face for contacting a desired work surface which is angled relative to a radial cross section of the shaft. The face may have a larger surface area than the surface area of the radial cross section of the shaft.

In one embodiment, the face may be generally flat. The bit may include side walls diverging from the shaft to define the perimeter of a face for contacting a desired work surface. The means for coupling the bit to the hammer may lock the bit from rotating radially and/or about the longitudinal axis of the shaft.

The present invention maximizes contact by the air hammer bit with the work surface, providing uniform hammering to the work surface during an air hammering operation. The air hammering bit of the present invention is beneficial for use in air hammering hard-to-reach or angled work surfaces.

BRIEF DESCRIPTION OF THE DRAWINGS

Other objects of the present invention and many of the attendant advantages of the present invention will be readily appreciated as the same becomes better understood by reference to the following detailed description when considered in connection with the accompany drawings in which like reference numerals designate like parts throughout the figures thereof, and wherein.

DETAILED DESCRIPTION OF THE PREFERRED EMBODIMENTS

The present invention is an air hammer bit for use with an air hammer system. The air hammer bit includes an angled head and elongate shaft for easy access to restricted work spaces which are not efficiently reachable utilizing a conventional air hammer system.

Figure 1:
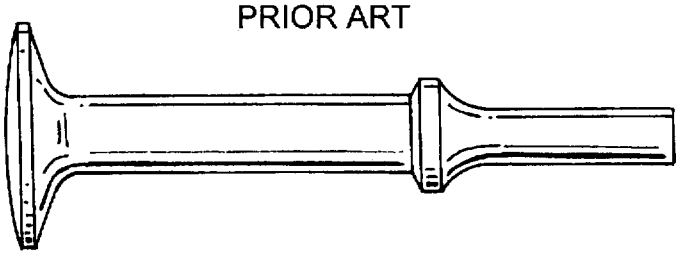
Fig.1 PRIOR ART
FIG. 1 is side elevational view of a prior art air hammer bit.
Figure 2:
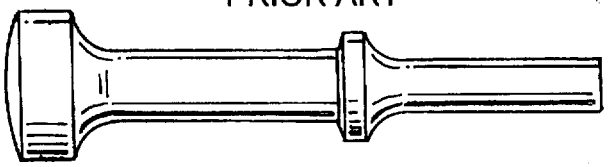
Fig.2 PRIOR ART
FIG. 2 is a side elevational view of another prior art air hammer bit.
Figure 3:
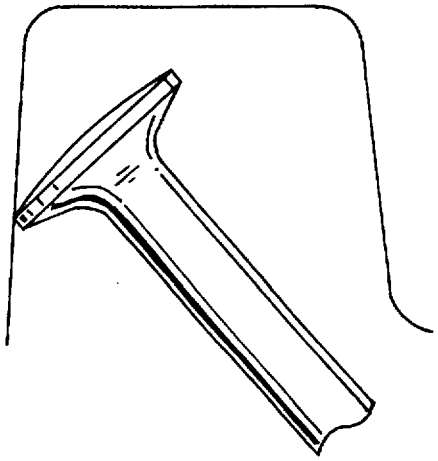
Fig.3 PRIOR ART
FIG. 3 is a fragmentary diagram of a work piece profile showing the prior art air hammer bit of FIG. 1 in operation.
Figure 4:
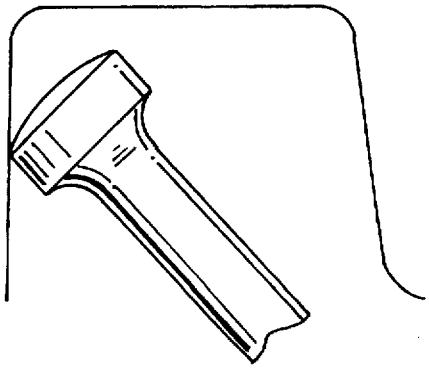
Fig.4 PRIOR ART
FIG. 4 is a fragmentary diagram of a work piece profile showing the prior art air hammer bit of FIG. 2 in operation.
Figure 5:
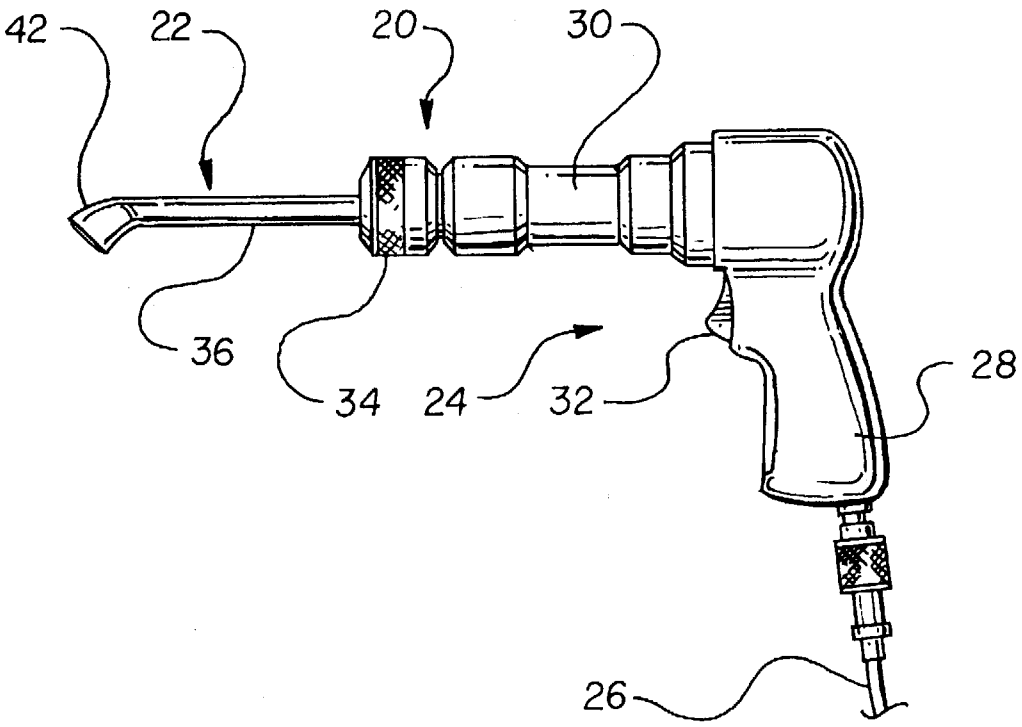
FIG. 5 is a right side elevational view of a pneumatic hammer system including an air hammer bit in accordance with the present invention.

FIG. 5 shows an air hammer system 20, utilizing an air hammer bit 22 in accordance with the present invention. Air hammer system 20 generally includes an air hammer (or pneumatic hammer) 24 which is coupled to a compressed air source (not shown) through a pneumatic hose 26. The air hammer 24 is generally "gun-shaped" and includes a grip 28 and a barrel 30. Extending from grip 28 is trigger 32, and coupled to the end of grip 28 is pneumatic hose 26. Located at the end of barrel 30 is a chuck 34. Chuck 34 couples air hammer bit 22 to the air hammer barrel 30.

In operation, pneumatic hammer 24 is activated by pressing trigger 32, releasing compressed air through the barrel 30 to operate upon air hammer bit 22. Air hammer bit 22 repeatedly projects outward from barrel 30, along the barrel's longitudinal axis, to operate to perform a hammering operation on a desired work area.

Figure 6:
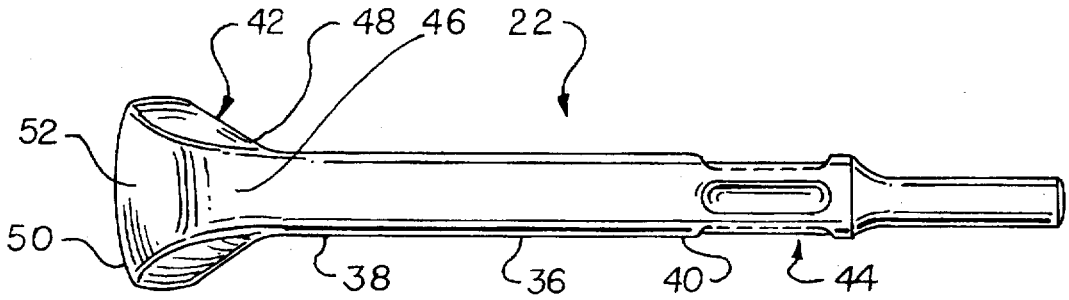
FIG. 6 is a top plan view of an air hammer bit in accordance with the present invention.

Referring to FIG. 6, air hammer bit 22 includes an elongate shaft (or shank) 36, having a first end 38 and a second end 40. Located at first end 38 is bit head 42, and located at second end 40 is coupling base 44.

Figure 7:
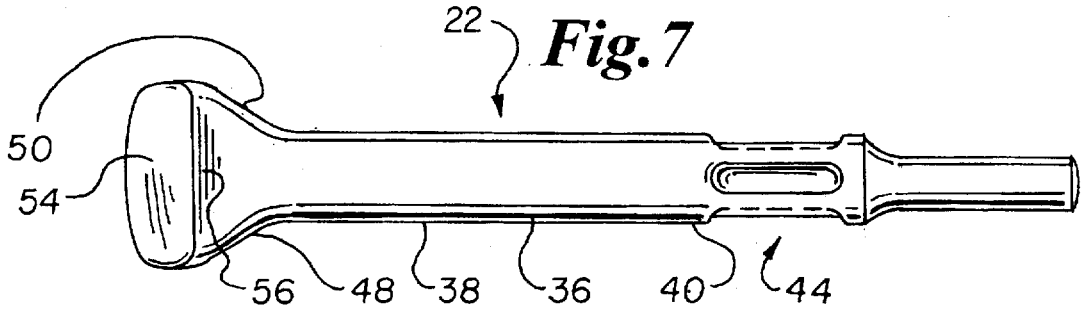
FIG. 7 is a bottom plan view of the air hammer bit shown in FIG. 6.

Bit head 42 is a formed extension of elongate shaft 36. Bit head 42 generally includes wrist 46, shoulder 48, shoulder 50, and top 52. Referring to FIG. 7, air hammer bit 22 further includes face (or work surface) 54 and heel 56. The edges of shoulder 48, shoulder 50, top 52 and heel 56 extend outward from elongate shaft 36 through wrist 46 to meet at the edges of face 54. The edges of face 54 may be slightly rounded.

Figure 8:
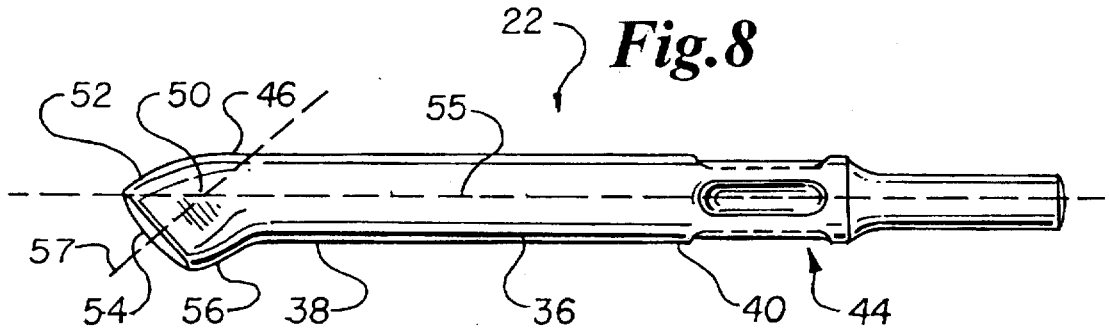
FIG. 8 is a side elevational view of the air hammer bit shown in FIG. 6.

Referring to FIG. 8, bit head 42 is angled relative to the longitudinal axis of elongate shaft 36 (indicated by dashed line 55). Correspondingly, face 54, which is the working surface of air hammer bit 22, is angled relative to the longitudinal axis of elongate shaft 36. In one preferred embodiment, a central axis 57 extending through bit head 42 forms an obtuse angle with the axis 55 extending longitudinally through elongate shaft 36.

Dashed line 57 indicates a central axis of bit head 42. Central axis 57, as shown, may be perpendicular to face 54. Central axis 57 forms an obtuse angle relative to longitudinal axis 55. Since air hammer bit head 42 is angled relative to the longitudinal axis 55 of shaft 36, an air hammer using the bit 22 is able to be efficiently utilized on working surfaces and areas which previously could not be efficiently air hammered using conventional bit configurations. Angled face 54 allows an air hammer operator to maximize the contact surface area of bit head 42 with a desired work surface.

Coupling base 44 is for coupling air hammer bit 22 to air hammer 24. In one preferred embodiment shown, the coupling base 44 is a locking base. The locking base does not allow longitudinal or axial movement of air hammer bit 42 relative to chuck 34. The locking base gives an air hammer operator control over the orientation of the air hammer bit 22. Although a locking base is shown, it is recognized that other types of coupling bases may be used for coupling air hammer bit 22 to pneumatic hammer 24.

Elongate shaft 36 is generally longer relative to conventional air hammer bits. The elongate shaft 36 of air hammer bit 22 allows work to be performed on areas not previously reachable by shorter conventional air hammer bits. Air hammer bit 22 is generally formed of a steel or iron. It is also recognized that air hammer bit 22 may be formed of other materials, such as carbon, rubber or plastic. Additionally, it is recognized that air hammer bit 22 may be dipped or coated, such as with a polymeric coating, or that face 54 may include a generally softer or non-metallic covering.

Figure 9:
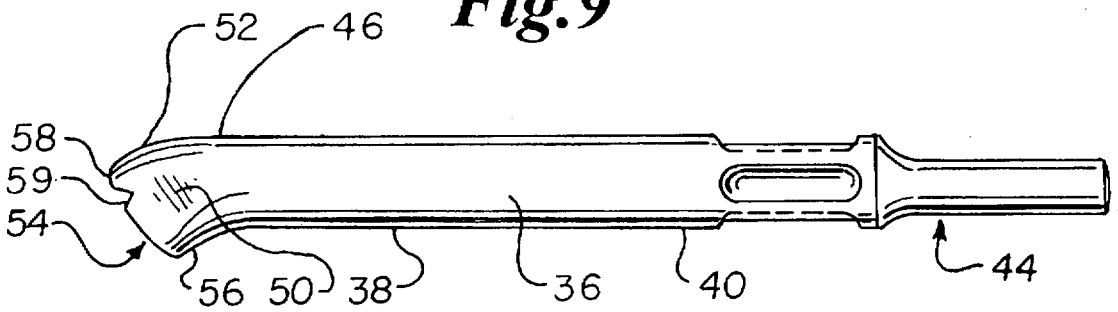
FIG. 9 is a side elevational view of an alternative embodiment of the air hammer bit in accordance with the present invention.
Figure 10:
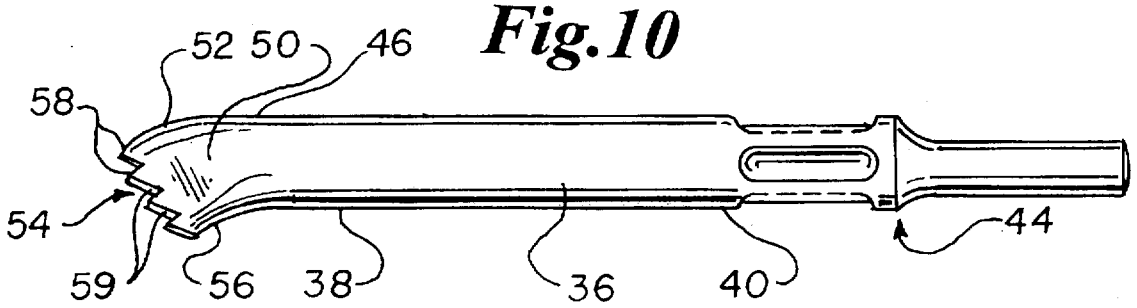
FIG. 10 is a side elevational view of another alternative embodiment of the air hammer bit in accordance with the present invention.

Referring to FIG. 9, an alternative embodiment for bit head 42 in accordance with the present invention is generally shown. In this embodiment, bit head 42 includes face 54, which has a roughened surface to aid in contacting a desired work surface. Face 54 may include teeth 58 and/or a groove 59 to aid in preventing the bit from sliding from a work surface during impact, or to engage, or dig into a work surface during hammering. Referring to FIG. 10, face 54 may include a plurality of teeth 58, grooves 59 or roughened areas.

Figure 11:
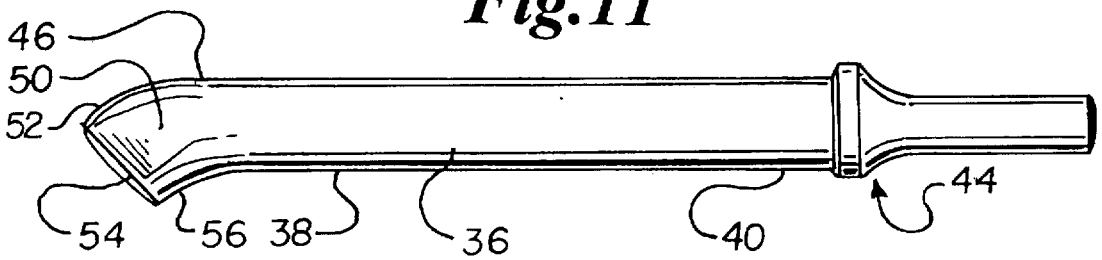
FIG. 11 is a side elevational view of another alternative embodiment of the air hammer bit in accordance with the present invention.

Referring to FIG. 11, it is recognized that alternative coupling bases 44 may be used within the scope of the present invention. The coupling base 44 shown is a rotatable base. The ring 60 locks within chuck 34, locking air hammer bit 22 in a direction along the longitudinal axis of shaft 36, but allowing movement in an axial direction relative to the longitudinal axis of elongate shaft 36.

Figure 12:
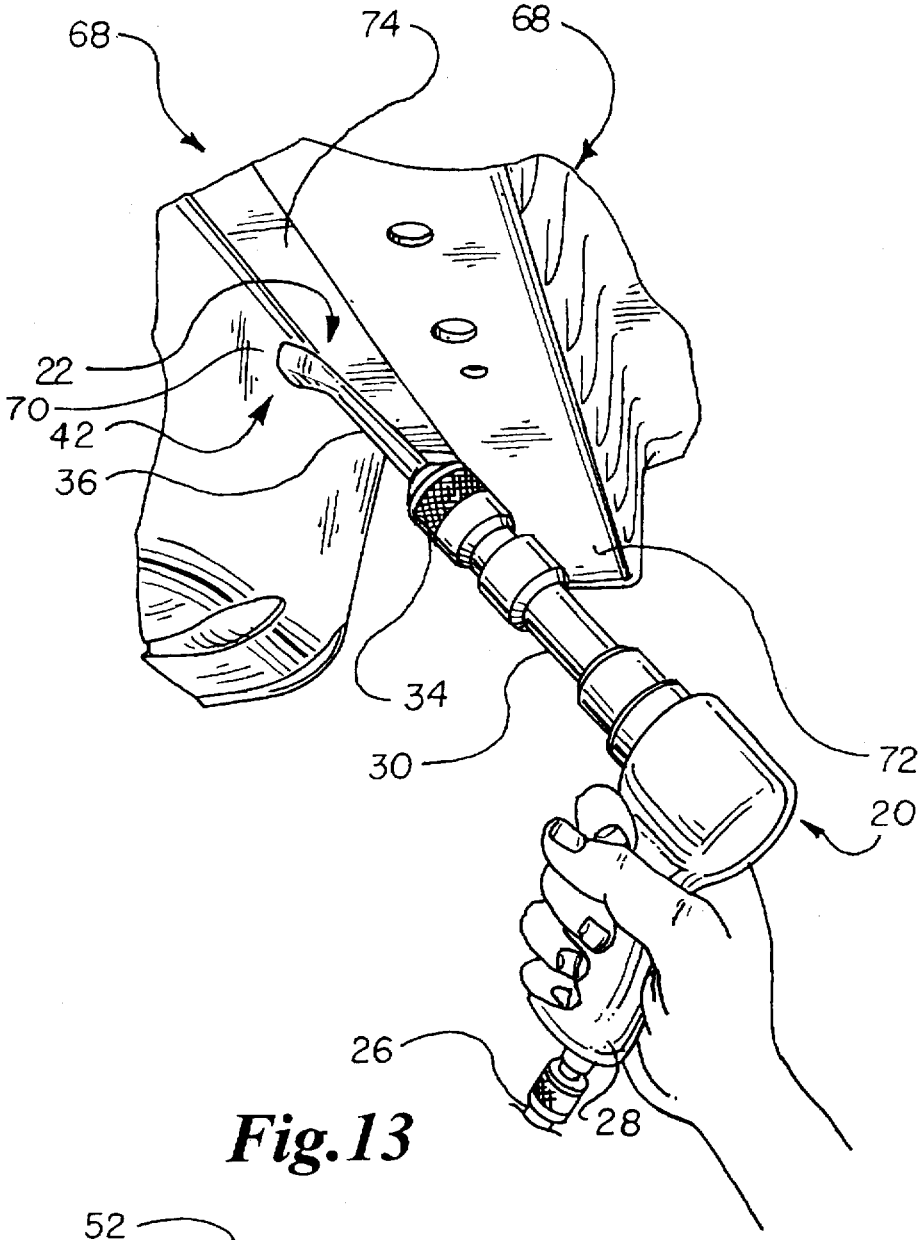
FIG. 12 is a fragmentary perspective view of an air hammer system in operation utilizing the air hammer bit of the present invention.

Referring to FIG. 12, air hammer system 20 utilizing air hammer bit 22 in accordance with the present invention, is shown generally in operation. The air hammer system 20 is shown working on an automotive body, which includes a substantially vertical panel work surface 70 and a frame 72 bordering channel 74. The unique design of air hammer bit 22 allows air hammer 24 to access work surface 70 near channel 74, and perform work on the work surface 70 (such as removing dents).

Air hammer bit 22 is first coupled to air hammer 24 by inserting the air hammer bit 22 into barrel 30, and coupling the air hammer bit 22 to barrel 30 at chuck 34. The bit head 42 face 54 is positioned near the desired location along work surface 70. The elongate shaft and angled bit head 42 of air hammer bit 22 allows air hammer 24 to access work areas which previously could not be reached by conventional air hammer systems.

Figure 13:
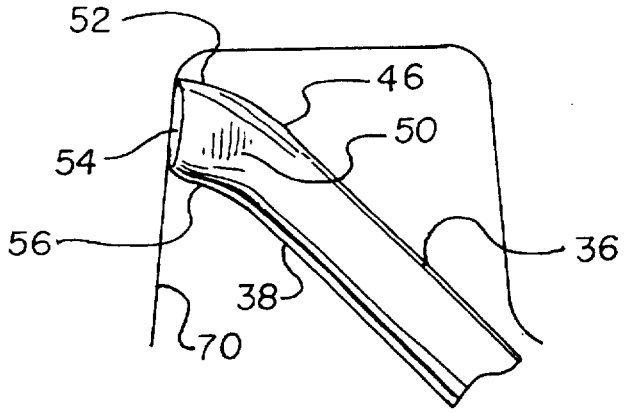
FIG. 13 is a fragmentary diagram of a work piece profile showing the air hammer bit of the present invention in operation.

The angled design of air hammer bit 22 allows air hammering to be efficiently performed upon vertical panel work surface 70. Referring to FIG. 13, since air hammer bit 22 is angled relative to the longitudinal axis of the air hammer bit shaft 36, maximum surface contact is made on vertical panel work surface 70 by air hammer bit 22 face 54. Full surface contact between air hammer bit 22 and work surface 70 allows for efficient, uniform hammering of work surface 70.

The air hammer bit 22 of the present invention is very useful when using air hammers for auto body work. Air hammer bit 22 allows an operator to access remote or restricted areas within an auto body, in one specific use for uniformly pounding out auto body dents or straightening of auto body panels. The angled bit head 42 allows maximum surface area contact of face 54 with the work surface, allowing uniform work to be completed upon the auto body during hammering operation. Use of the air hammer bit of the present invention no longer requires work space for the air hammer barrel to be perpendicular to the work surface for maximum contact of the work surface with the air hammer bit 22 face 54.

Additionally, the use of a roughened face 54 or teeth 58 allow air hammer bit 22 to engage the work surface 70 during a hammering operation. Teeth 58 aid in keeping the air hammer bit 22 from slipping away from the work surface 70 during a hammering operation.

It will be understood that this disclosure is, in many respects, only illustrative. Changes may be made in details, particularly in matters of shape, size, material, and arrangement parts, without exceeding the scope of the invention.

For example, the air hammer bit head may take on different sizes, shapes and configurations, including being generally round or oval shaped, and may include a more rounded face. Additionally, the means for coupling the air hammer bit to the air hammer may take on different designs. It is also recognized that the coupling base 44 may be a generally smooth shaft, with a locking mechanism solely contained within chuck 34, similar to that of a conventional drill. Accordingly, the scope of the invention is as defined in the language of the appended claims.

What is claimed is:

1. An air hammer bit for use with an air hammer for operating on a desired workpiece, the air hammer bit comprising:

a generally elongate shaft having a generally cylindrical shape and having a first end and a second end, with a longitudinal axis extending therethrough;

a coupling mechanism located near the first end of the shaft and formed integral the shaft for aiding in coupling the generally elongate shaft to the air hammer; and a bit head located at the second end of the shaft and formed integral the shaft, the bit head having a center axis which is angled relative to the longitudinal axis of the shaft, wherein the bit head includes a face for contacting a desired work surface which is angled relative to a radial cross section of the shaft, and wherein the face has a larger surface area than the surface area of the radial cross section of the shaft, and wherein the face is roughened to aid in contacting the desired work surface in order to apply a bending face to the desired workpiece.

2. The air hammer bit of claim 1, wherein the toughened face includes a set of directional teeth to aid in engaging the work surface.

3. The bit of claim 1, wherein the means for coupling the bit to the hammer locks the bit from rotating radially about the longitudinal axis of the shaft.

* * * * *